US011843172B2

(12) United States Patent
Lou et al.

(10) Patent No.: US 11,843,172 B2
(45) Date of Patent: Dec. 12, 2023

(54) PATCH ANTENNA

(71) Applicant: QuantumZ Inc., Kaohsiung (TW)

(72) Inventors: Chih-Yang Lou, Kaohsiung (TW); Meng-Hua Tsai, Kaohsiung (TW); Wei-Ting Lee, Kaohsiung (TW); Sin-Siang Wang, Kaohsiung (TW)

(73) Assignee: QUANTUMZ INC., Kaohsiung (TW)

( * ) Notice: Subject to any disclaimer, the term of this patent is extended or adjusted under 35 U.S.C. 154(b) by 44 days.

(21) Appl. No.: 17/689,952

(22) Filed: Mar. 8, 2022

(65) Prior Publication Data

US 2023/0033007 A1 Feb. 2, 2023

(30) Foreign Application Priority Data

Jul. 27, 2021 (TW) ..... 110127564

(51) Int. Cl.
*H01Q 19/00* (2006.01)
*H01Q 13/10* (2006.01)
*H01Q 9/04* (2006.01)

(52) U.S. Cl.
CPC ..... *H01Q 19/005* (2013.01); *H01Q 9/0414* (2013.01); *H01Q 13/10* (2013.01)

(58) Field of Classification Search
CPC ..... H01Q 19/005; H01Q 9/0414; H01Q 13/10
See application file for complete search history.

(56) References Cited

U.S. PATENT DOCUMENTS 5,680,144 A * 10/1997 Sanad ..... H01Q 1/2208 343/702
6,496,148 B2 * 12/2002 Ngounou Kouam .. H01Q 5/371 343/846

FOREIGN PATENT DOCUMENTS

CN 111987409 A * 11/2020 ..... B60J 1/00

* cited by examiner

*Primary Examiner* — Dieu Hien T Duong
(74) *Attorney, Agent, or Firm* — Leong C. Lei

(57) ABSTRACT

A patch antenna includes a dielectric substrate formed by a high dielectric coefficient material covered with a soft material. The dielectric substrate has a first surface, an opposite second surface, and surrounding side surfaces there between. The patch antenna further includes a radiating metal arm formed on at least the first surface with a thin metal layer in a specific shape, a grounding metal plate disposed on the second surface, and a parasitic metal arm extending from the grounding metal plate towards the first surface via at least one of the side surfaces. The parasitic metal arm is approximate but not connected to the radiating metal arm. The radiation metal arm further includes an enclosed slot, together with the parasitic metal arm, improve the working bandwidth and high directivity of the antenna.

11 Claims, 5 Drawing Sheets

PATCH ANTENNA

CROSS-REFERENCE TO RELATED APPLICATION

This application claims the benefit of Taiwan Patent Application No. 110127564, filed on Jul. 27, 2021, which is hereby incorporated by reference for all purposes as if fully set forth herein.

BACKGROUND

Technical Field

The present invention relates to a patch antenna, and specifically, to a patch antenna designed with a soft material coated with a high dielectric coefficient material.

Related Art

Nowadays, a patch antenna in a sub-6G band is mainly designed with an FR4 board material. Because the band is low, the size of the antenna is large, and the material of the antenna is neither transparent nor flexible, an application range is limited. FPC PI (Polyamide) is an alternative material for patch antenna in the sub-6G band, but the thickness of the substrate is not thick enough and has led to poor performance of the antenna.

The patch antenna is currently designed with either FR4 or FPC, and a hole feed method is often used to obtain a good frequency matching. Other types of antenna are limited by surrounding metal environments or grounding methods, their directivities are lesser than patch antenna.

China Patent No. CN202011363160.4 discloses a microstrip antenna and a terminal device. Based on a conventional U-shaped metal patch, a via-hole is opened on each of a first vertical part and a second vertical part of the U-shaped metal patch in the microstrip antenna to extend the path of the current flow, so that a resonant frequency of the antenna is reduced, thereby the bandwidth of the antenna is increased. In addition, because the via-hole is only opened on each of the first vertical part and the second vertical part, there is no need to increase the length and the width of the metal patch. The metal patch is lighter and easier to meet the requirement of structural compactness.

The above-mentioned patent extends the flow path of the current and reduces the resonant frequency of the antenna. However, it does not solve problems that a patch antenna designed with a PCB substrate is too large in size and hence too limited in its applications. On the other hand, a patch antenna designed with a FPC substrate cannot be used in the sub-6G band due to insufficient thickness and poor bandwidth. A patch antenna with higher directivity gain is needed, therefore, the present invention proposes a new type of patch antenna.

A patch antenna produced with glass coated with LCP (Liquid Crystal Polymer). The high dielectric coefficient of the glass (a value of K>6) can reduce the size of the patch antenna. The glass can also provide sufficient thickness for the antenna to have a good performance and still maintain a high directivity. In this way, the antenna has a wider application range, using microstrip slot feeds on the patch antenna to overcome the problem that glass cannot be drilled through as feed holes to obtain a good feed matching.

SUMMARY

In view of shortcomings of the related art, the present invention discloses a patch antenna to solve the above-mentioned existing problems. The present invention discloses a patch antenna, including:

- a dielectric substrate, formed by a soft material coated over a high dielectric coefficient material, and comprising a first surface and a second surface opposite to each other, and a plurality of side surfaces arranged circumferentially between the first surface and the second surface;
- a radiating metal arm, arranged on at least the first surface, and having a thin metal layer with a predetermined shape;
- a ground metal plate, being a thin metal sheet arranged on the second surface; and
- a parasitic metal arm, extending from the ground metal plate on the second surface to the first surface via at least one of the side surfaces to form a predetermined shape, and being approximate but not connected to the radiating metal arm.

The material of the thin metal layer may be selected from copper, aluminum, silver, or compositions thereof.

The soft material may be selected from an LCP (Liquid Crystal Polymer) material.

One or more layers of LCP materials may be applied.

The high dielectric coefficient material may be selected from a glass material.

A dielectric coefficient K of the glass material is greater than 6.

When the patch antenna is operated on the dielectric substrate, signals are fed through a slot feed method or an LCP multilayer feed method.

An enclosed slot with a predetermined shape may be produced by a process such as photolithography on the thin metal layer of the radiating metal arm on the first surface.

The enclosed slot may be in a U shaped or other symmetrical shapes, and the slot needs to be arranged within the radiating metal arm.

The parasitic metal arm extends from the ground metal plate on the second surface at the bottom of the dielectric substrate, and is approximate but not connected to the radiating metal arm.

A total length of the U shaped slot produced by performing photolithography on the thin metal layer of the radiating metal arm is substantially the wavelength of the corresponding frequency.

A total length of the parasitic metal arm extending from the first surface to the side surface is substantially equal to ¼ of a wavelength of the corresponding frequency.

An antenna feed region is arranged on the radiating metal arm.

At least one feed slot is further arranged on the radiating metal arm.

The feed slot is located between the thin metal layer of the radiating metal arm and the parasitic metal arm.

In the present invention, an antenna designed with LCP coated with a glass material is designed, where a microstrip slot feed method or an LCP multilayer feed method may be used to solve the frequency matching problem because the glass material cannot be drilled through as feeding holes. In addition, the U shaped slot and a side parasitic metal arm are designed in a radiating surface of the patch antenna to increase a workable bandwidth of the antenna. The designed glass patch antenna is more miniaturized, has the sufficient workable bandwidth, a high directivity and more workable bandwidths, and can be designed on a plurality of sub-6G bands, where an antenna gain of 5 GHz can reach 3.4 dBi and a bandwidth ratio is 18%.

BRIEF DESCRIPTION OF THE DRAWINGS

In order to make the above-mentioned and other objectives, features, advantages, and embodiments of the present invention more comprehensible, the accompanying drawings are described as follows.

DETAILED DESCRIPTION

Figure 1:
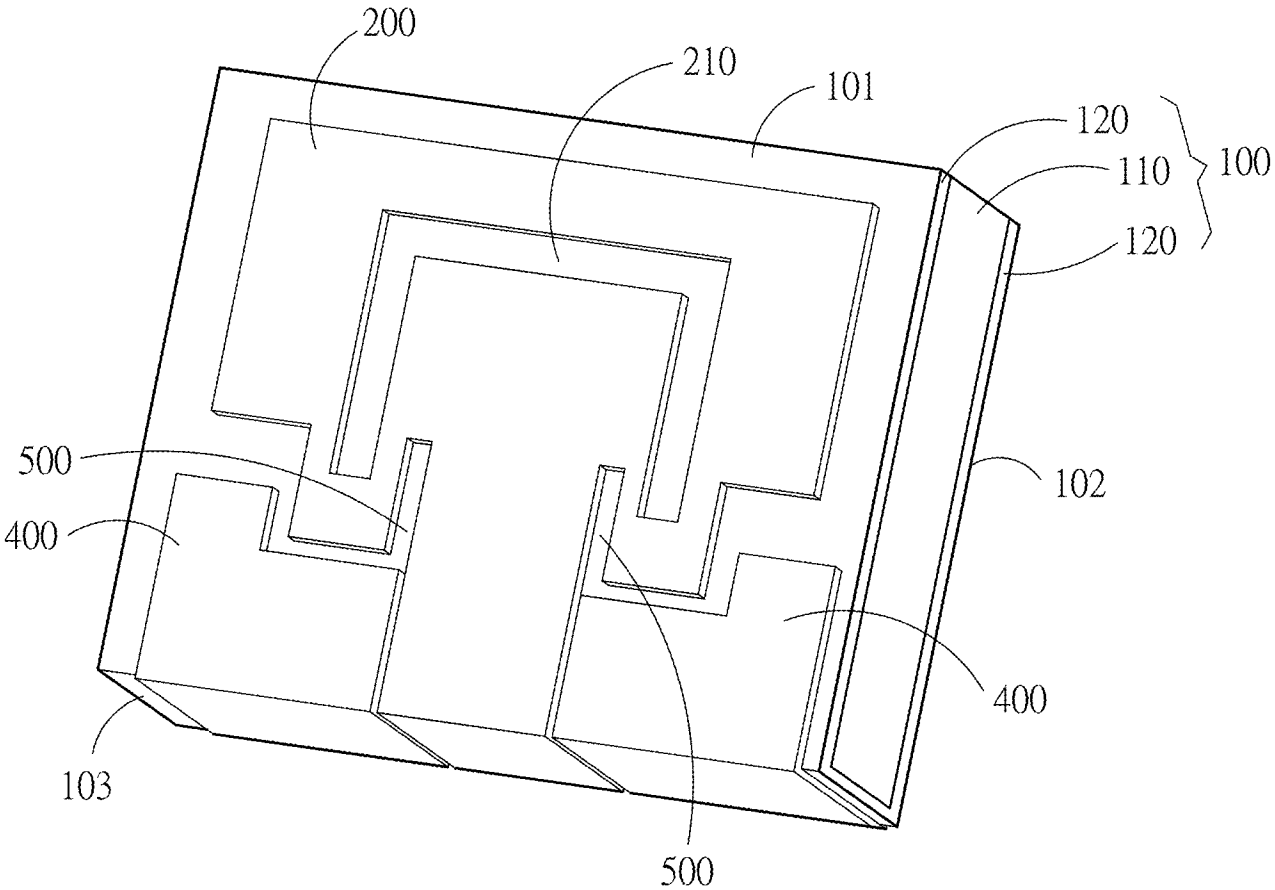
FIG. 1 is a structural diagram of a patch antenna according to an embodiment of the present invention.
Figure 2:
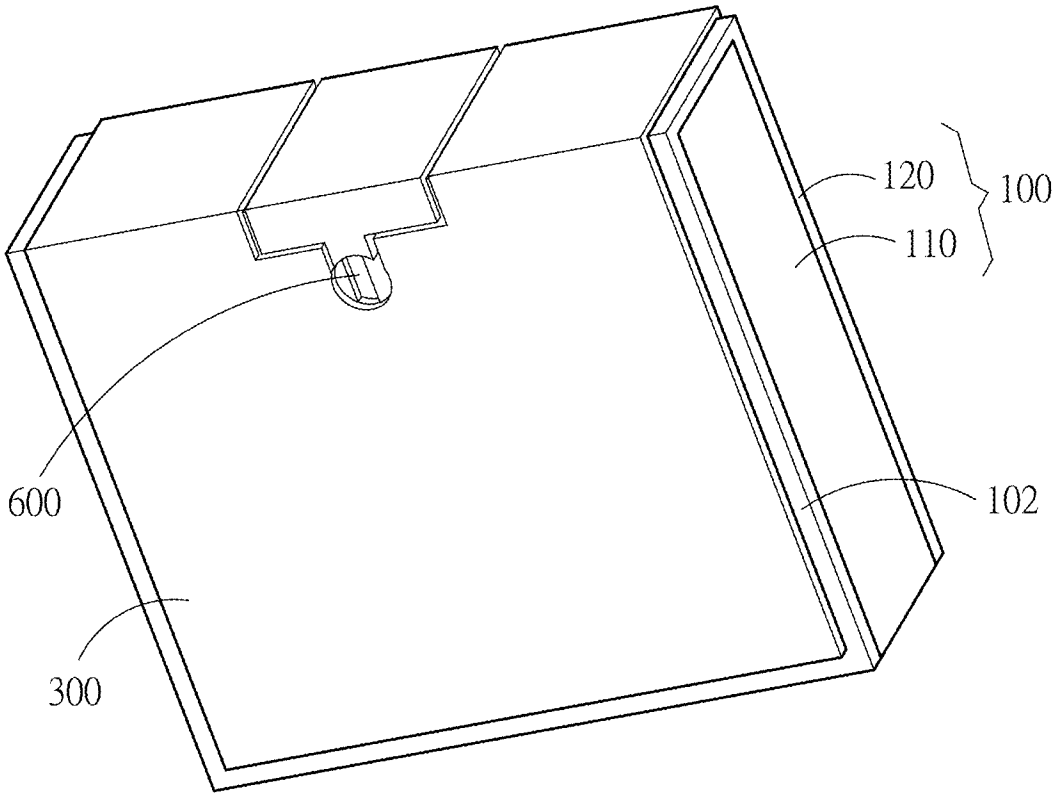
FIG. 2 is a diagram of an antenna feed region according to an embodiment of the present invention.

Referring to FIG. 1 and FIG. 2, an exemplary embodiment of a patch antenna according to the present invention. A dielectric substrate 100 formed by a soft material 120 coated over a high dielectric coefficient material 110. The dielectric substrate 100 has a first surface 101, an opposite second surface 102, and a plurality of side surfaces 103 arranged circumferentially between the first surface 101 and the second surface 102. A radiating metal arm 200 is arranged on at least the first surface 101, and has a thin metal layer with a predetermined shape. The shape may be produced through a process such as dry or wet etching. A ground metal plate 300 is arranged on the second surface 102. A parasitic metal arm 400 extends from the ground metal plate 300 to the first surface 101 through at least one of the side surfaces 103 to form a predetermined shape. The parasitic metal arm 400 is approximate but not connected to the radiating metal arm 200.

In this embodiment, LCP material is used for its low loss, low water absorption, and good flexibility properties. LCP provides stable and bendable applications to antenna and therefore is a good choice of material for a high-frequency antenna.

In this embodiment, signals are feed by a slot feed method or an LCP multilayer feed method when the patch antenna is operated on the dielectric substrate.

In this embodiment, LCP is selected as the soft material 120, and one or multiple layers of LCP materials may be used. The glass is selected as the high dielectric coefficient material 110 where a dielectric coefficient K of the glass material is greater than 6.

In this embodiment, the total length of the parasitic metal arm 400 extending from the first surface 101 to the side surface is substantially equal to ¼ of the wavelength of the corresponding frequency.

In this embodiment, an antenna feed region is arranged on the radiating metal arm 200. At least one feed slot 500 is further formed on the radiating metal arm 200, and the feed slot 500 is located between the thin metal layer of the radiating metal arm 200 and the parasitic metal arm 400.

In this embodiment, the thickness of the dielectric substrate 100 is less than the wavelength. The second surface 102 of the substrate includes the ground metal plate 300, and the first surface 101 includes a thin metal layer with a predetermined shape as the radiating metal arm 200. The radiating metal arm 200 may differ in shapes as required by designed. The parasitic metal arm 400 extends from the ground metal plate 300 to the first surface 101 via at least one of the side surfaces 103 to form a predetermined shape, and is approximate but not connected to the radiating metal arm 200.

In other embodiments of the patch antenna according to the present invention, the shape of the radiating metal arm 200 may be a regular rectangle or polygon, an irregular ellipse, loop, or sector, or the like. Such shapes may be produced through dray or wet etching process such as photolithography, chemical, gaseous or plasma etching.

In this embodiment, an enclosed slot 210 is formed in the radiating metal arm 200. The enclosed slot 210 is a U shaped slot (or an inverted U-shaped slot). In other embodiments, the shape of the enclosed slot 210 is not limited to a U shape, it may be another shapes such as a meniscus shape or a spire shape, as long as the slot is formed within the radiating metal arm 200. The total length of the enclosed slot 210 is substantially equal to one wavelength of the corresponding frequency.

In this embodiment, two parasitic metal arms 400 extend from the ground metal plate 300 arranged on the second surface 102 at the bottom of the dielectric substrate 100, and are approximate but not connected to the radiating metal arm 200.

The enclosed slot 210 formed in the radiating metal arm 200, calculated by the center line, has the total length approximately equal to the wavelength, and the length of the parasitic metal arm 400 is approximately a quarter of the wavelength. For example, at the frequency of 5.5 GHz, the wavelength is about 21.00 mm, so the length of the enclosed slot 210 is about 21.50 mm to 22.50 mm, and the length of the parasitic metal arm 400 is about 4.85 mm to 5.65 mm may achieve desirable performances.

In this embodiment, the enclosed slot 210 with a length of 22 mm formed in the radiating metal arm 200, and a parasitic metal arm 400 with a length of 5.28 mm are formed. The best performance may be achieved for the frequency of 5.76 GHz. A microstrip may be configured to feed from a side of the antenna, and the feeding point of the patch antenna may be adjusted according to its actual application and not limited to as illustrated in this embodiment. Also, it is convenient to adjust overall matching conditions of the antenna by adjusting the design of the feed slot 500, to create favorable working and radiation conditions for the antenna.

In this exemplary embodiment, as shown in FIG. 1, at a center frequency of 5.5 GHz, the feed slot 500 is located between the thin metal layer of the radiating metal arm and the parasitic metal arm 400. The feed slot 500 has a depth of 3 mm to 5 mm and a width of 0.4 mm to 0.6 mm, and a desirable frequency response may be obtained at this frequency.

In this embodiment, the enclosed slot 210 (U shaped slot) is formed in the radiating metal arm 200 of the antenna. With this slot resonant path, an optimized bandwidth result can be achieved within a desired operating frequency range. Moreover, two metal parasitic branches extend from the ground metal plate 300 on the second surface 102 are approximate but not connected to the radiating metal arm 200. This parasitic branch may also optimize the bandwidth.

In this embodiment, as shown in FIG. 2, an antenna feed region 600 is arranged on the ground metal plate 300. The thin metal layer is made of copper, aluminum, silver or compositions thereof. In other embodiments, the thin metal layer may alternatively be made of other conductive materials.

In this embodiment, the low bandwidth of the patch antenna is improved. Taking the center frequency of 5.5

Figure 3:
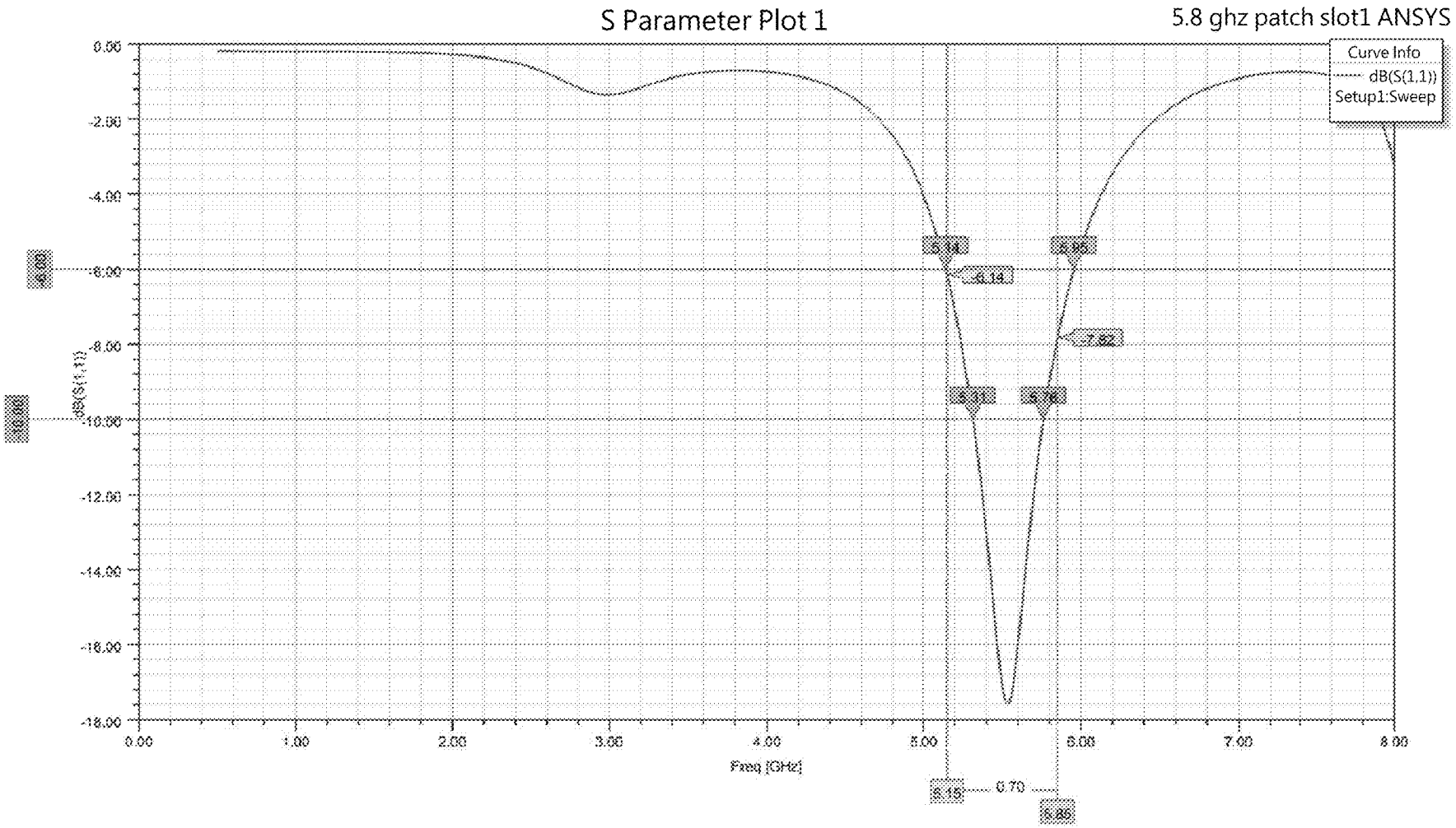
FIG. 3 is a frequency response diagram of an antenna return loss.
Figure 4:
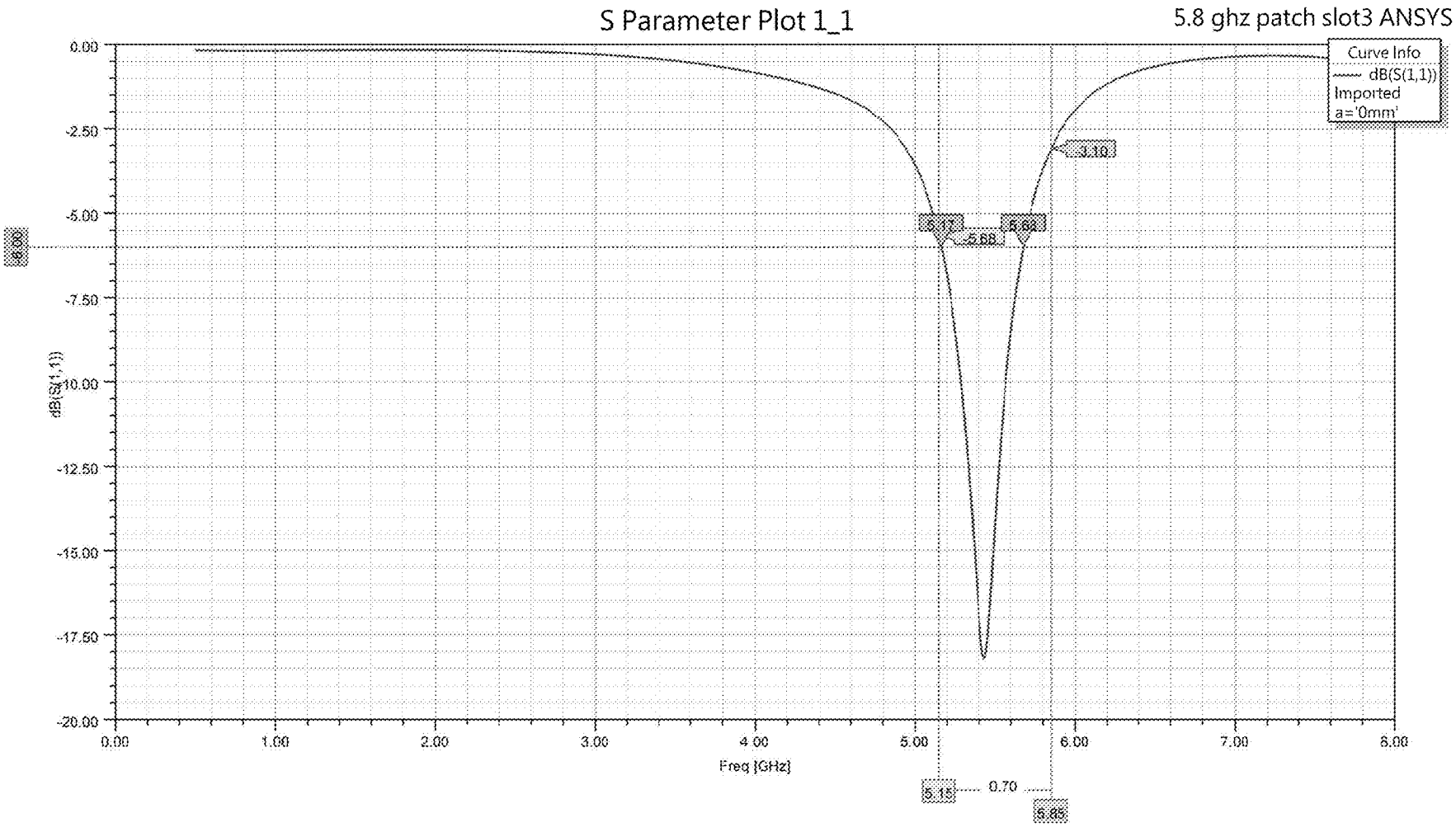
FIG. 4 is a simulation response diagram of a conventional patch antenna.

GHz as an example, the total length of a central line of the enclosed slot 210 (U shaped slot) is about 19.90 mm, and the length of the parasitic metal arm 400 is about 4.95 mm. Referring to FIG. 3, the bandwidth of S11=−6 dB is 98 MHz. FIG. 4 is a simulation response diagram of a conventional patch antenna, and the bandwidth of S11=−6 dB is 51 MHz. In this example, the bandwidth is increased by 92% with the enclosed slot 210 (U shaped slot) and the parasitic metal arm 400.

Figure 5:
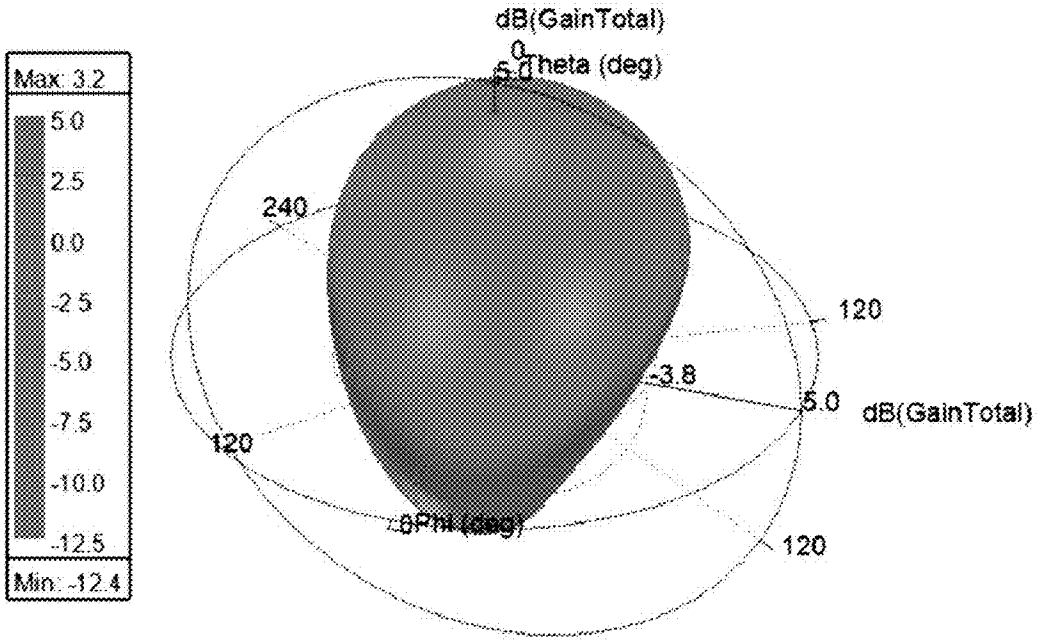
FIG. 5 is a 3D radiation diagram of an antenna gain.

In this embodiment, the simulation response diagram of the antenna is shown in FIG. 3. When the antenna is operated at the center frequency of 5.5 GHz, a return loss of the antenna is −16 dB, a bandwidth ratio of S11=−6 dB is 18%, and an overall size of the antenna is 15×15×2 mm. With a 3D radiation pattern of a single antenna, an antenna gain reaches 3.4 dBi as shown in FIG. 5. The same antenna design may be applied to more sub-6G bands.

In this embodiment, the LCP material is used to coat over the glass material (a high-dielectric transparent material 110 with a value of K greater than 6) to produce a dielectric substrate 100 for the patch antenna according to the present invention, where the first surface 101 is the radiating metal arm 200, the second surface 102 is the ground metal plate 300 that can be grounded, and the parasitic metal arm 400 extends from the ground metal plate 300 to the first surface 101 through at least one of the side surfaces to form the specific shape, and is approximate but not connected to the radiating metal arm 200.

In this embodiment, the microstrip feeds from the side, and a slot is used in the antenna feed region 600 of the microstrip to achieve a good feed matching. The length of the microstrip can be extended without limitation to facilitate a feeding of a device.

In a further implementation, an LCP multilayer structure with feed microstrips arranged in different layers may alternatively be used in the antenna feed region 600. An LCP multilayered board with different metal forms disposed in different layers may also alternatively be used to achieve a similar effect.

In other embodiments, the parasitic metal arm 400 extends from the ground metal plate 300. The parasitic metal arm 400 is approximate to the antenna feed region 600 and produces a coupling effect with the feed region. The parasitic metal arm 400 needs to be connected to or very close to the ground metal plate 300. According to a high frequency response formula, the higher a capacitance value, the lower an impedance value. When the capacitance value is high enough, the impedance value is close to 0 and can be regarded as a short circuit.

An impedance formula is as follows:

$$Zc = \frac{-j}{2\pi f C}$$

f=frequency, $j=\sqrt{-1}$, and C=capacitance value.

In a further implementation, the parasitic metal arm 400 and the ground metal plate 300 may produce a larger capacitance effect by using some passive components or a metal overlapping method to produce a similar effect.

Generally, the patch antenna designed with a PCB substrate is too large in size and hence limited in applications. The patch antenna designed with a soft FPC substrate cannot be used in a sub-6G band due to the insufficient thickness. Moreover, patch antenna with FPC has a narrower bandwidth and a higher directivity gain cannot be achieved.

The LCP material is selected to coat over the glass material to produce the patch antenna. The size of the patch antenna can be reduced by the high dielectric coefficient (K>6) of the glass material. The glass material provides a sufficient thickness, so that the antenna may have better performance while a high directivity of the patch antenna may still be maintained. A microstrip slot feed is used on the patch antenna to obtain a good feed matching and overcome the problem that feed through holes cannot be drilled in the glass material. In addition, the U shaped slot and the side parasitic metal arm 4 are arranged on the radiating surface of the patch antenna to increase the workable bandwidth of the antenna.

In summary, in the present invention, the patch antenna is designed with a dielectric substrate formed by a glass coated with LCP, where a microstrip slot feed method or LCP multilayer feed method is used for frequency matching. Problems of feeding holes cannot be drilled in the glass material is solved. In addition, the enclosed slot 210 (U shaped slot) and the side parasitic metal arm 400 are arranged in a radiating surface of the patch antenna to increase the workable bandwidth of the antenna. The patch antenna is more miniaturized and has sufficient workable bandwidth. Because the substrate is made of glass, the patch antenna according to the present invention allow more versatile product applications.

In the present invention, this structure of the patch antenna has the high directivity and more workable bandwidths that can be utilized on various sub-6G bands, where the antenna gain of 5 GHz can reach 3.4 dBi and the bandwidth ratio is 18%.

The above-mentioned embodiments are only used to illustrate but not to limit the technical solutions claimed in the present invention. Although this application has been described in detail with reference to the above-mentioned embodiments, persons of ordinary skill in the art should understand that they can still modify the technical solutions described in the above-mentioned embodiments, or equivalently replace some of the technical features. These modifications or replacements do not cause the essence of the corresponding technical solutions to deviate from the spirit and scope of the technical solutions of the embodiments of this application.

What is claimed is:

1. A patch antenna, comprising:

a dielectric substrate, comprising a first surface and a second surface opposite to each other, and a plurality of side surfaces arranged circumferentially between the first surface and the second surface, wherein the dielectric substrate is made of a soft material coated over a high dielectric coefficient material, and the high dielectric coefficient material is a glass material;

a radiating metal arm, located on at least the first surface, and forming a thin metal layer with a predetermined shape;

a ground metal plate, being a thin metal sheet arranged on the second surface; and a parasitic metal arm, extending from the ground metal plate on the second surface to the first surface via at least one of the side surfaces to form a predetermined shape, and being approximate but not connected to the radiating metal arm;

wherein the radiating metal arm is not connected to the ground metal plate; and the radiating metal arm, the ground metal plate and the parasitic metal arm are arranged around the glass material of the dielectric substrate.

2. The patch antenna of claim 1, wherein the soft material is one or more layers of LCP materials.

3. The patch antenna of claim 1, wherein the high dielectric coefficient material is the glass material with a dielectric coefficient K greater than 6.

4. The patch antenna of claim 1, wherein when the patch antenna is operated on the dielectric substrate, and signals are fed by a slot feed method or an LCP multilayer feed method.

5. The patch antenna of claim 1, wherein the radiating metal arm further includes at least one slot enclosed therein.

6. The patch antenna of claim 5, wherein a total length of the slot is substantially equal to the wavelength of corresponding frequency.

7. The patch antenna of claim 5, wherein the total length of the parasitic metal arm extending from the first surface to the side surface is substantially equal to ¼ of the wavelength of corresponding frequency.

8. The patch antenna of claim 5, wherein the slot enclosed in the radiating metal arm may be in a U shape or other or other symmetrical shapes.

9. The patch antenna of claim 1, wherein an antenna feed region is arranged on the first surface, the second surface, or the side surface; and the radiating metal arm extends from the first surface and is connected to the antenna feed region.

10. The patch antenna of claim 1, wherein the thin metal layer is made of copper, aluminum, silver or compositions thereof.

11. The patch antenna of claim 1, wherein at least one feeding slot is further formed on the radiating metal arm.

* * * * *